United States Patent [19]

Pacca

[11] Patent Number: 4,742,647

[45] Date of Patent: May 10, 1988

[54] WINDOW CONSTRUCTION AND COMPONENTS

[76] Inventor: Stephen R. Pacca, 150 Overlook Ave., Apt. 15F, Hackensack, N.J. 07601

[21] Appl. No.: 40,034

[22] Filed: Apr. 20, 1987

[51] Int. Cl.[4] ..... E06B 1/04

[52] U.S. Cl. ..... 49/505; 49/380; 49/DIG. 2

[58] Field of Search ..... 49/380, 505, DIG. 2; 52/217

[56] References Cited

U.S. PATENT DOCUMENTS 3,583,114 6/1971 Belfor ..... 49/505

*Primary Examiner*—Philip C. Kannan

*Attorney, Agent, or Firm*—Charles E. Baxley

[57] ABSTRACT

A window construction has a frame with side members having longitudinal slots along the outer periphery thereof and expansion members engaging the slots and movable between closed positions and open positions in which the width of the frame is effectively increased, thereby to facilitate installation of the window frame. The frame also has a sill member and a head member and the side members, the sill member and the head member have casing slot portions that together provide a casing slot extending completely around the window frame, for sealingly receiving a casing therein. The window also has inner and outer sashes each having bottom, top and side members, and inner and outer moldings in snap-fit engagement therewith. The snap-fit engagement holds inner and outer panes in sealing engagement with the bottom, top and side members.

13 Claims, 3 Drawing Sheets

WINDOW CONSTRUCTION AND COMPONENTS

RELATED APPLICATIONS

This application is related to U.S. patent applications Ser. Nos. 07/040,028 filed 4/20/87; 07/040,283 filed 4/20/87; 07/040,819 filed 4/21/87.

BACKGROUND OF THE INVENTION

This invention relates to window construction and components and more particularly to improved replacement window construction and components overcoming many disadvantages of the prior art.

Prior replacement windows typically require the removal of the inside stop molding and trim for installation. It is known that this necessary removal causes many problems, such as broken moldings, chipped moldings and cracked paint.

Prior replacement windows require, in installation, that the casing be returned into the window and caulked. The cost of the caulking is substantial, both as to materials and as to labor.

There have been prior replacement windows utilizing systems of insulating glass, but these systems used a storm panel for the inside panel and a fixed piece of glass for the outside panel.

Furthermore, prior relacement windows have sashes that are undesirably thin, in terms of the dimension between the remote faces of the inside pane and the outside pane, it being known that an increase in the dimension referred to would enhance the thermal efficiency and sound deadening properties of the sash.

The present invention presents a substantial improvement over the prior art, in that the inventive window is an expansion window that includes expansion members, and that the window does not require removal of the inside stop moldings and trim for installation, thus avoiding problems such as broken moldings, chipped moldings and cracked paint.

The invention furthermore provides a window that includes a casing slot to receive a casing, eliminating about half of the heretofore required caulking both as to material and labor.

The invention additionally provides an improved sash construction that incorporates unique snap-in moldings enabling an increase in the dimension between the remote faces of the inside window pane and the outside window pane with no increase in overall sash thickness, this dimensional increase in effect making the panes an insulating glass system of enhanced thermal efficiency and sound deadening properties.

The invention also achieves an improved sash construction having panes that are readily removable by virtue of the unique snap-in moldings.

The invention also provides a sash construction of enhanced appearance, in that the unique snap-in moldings give the sash a "built-in" look.

Important objects of the invention are to provide improved window construction and components thereof having the above advantages.

Additional objects and advantages will appear hereinafter.

SUMMARY OF THE INVENTION

A window construction according to the invention has a frame with a sill member, a head member, a left side member and a right side member, an inner sash and an outer sash, each having bottom, top and side members.

In a first important aspect, the side members of the frame have longitudinal slots along the outer periphery thereof and expansion members engaging the slots and movable between closed positions and open positions in which the width of the frame is effectively increased, thereby enabling installation of the window frame without removing the existing inside moldings.

In a second important aspect, the frame also has a sill member, side members and a head member having casing slot portions that together provide a casing slot extending completely around the window frame, for sealingly receiving a casing therein in such a manner as to eliminate about half of the caulking normally required and creating a positive water and air seal.

In a third important aspect, the window also has inner and outer sashes of enhanced thermal efficiency and sound deadening properties. The sashes have unique bottom, top and side members and unique inner and outer moldings in snap-fit engagement therewith, holding inner and outer panes in sealing engagement with the bottom, top and side members, the inner and outer moldings creating an appearance enhancing "built-in" look.

DESCRIPTION OF THE INVENTION

Figure 1:
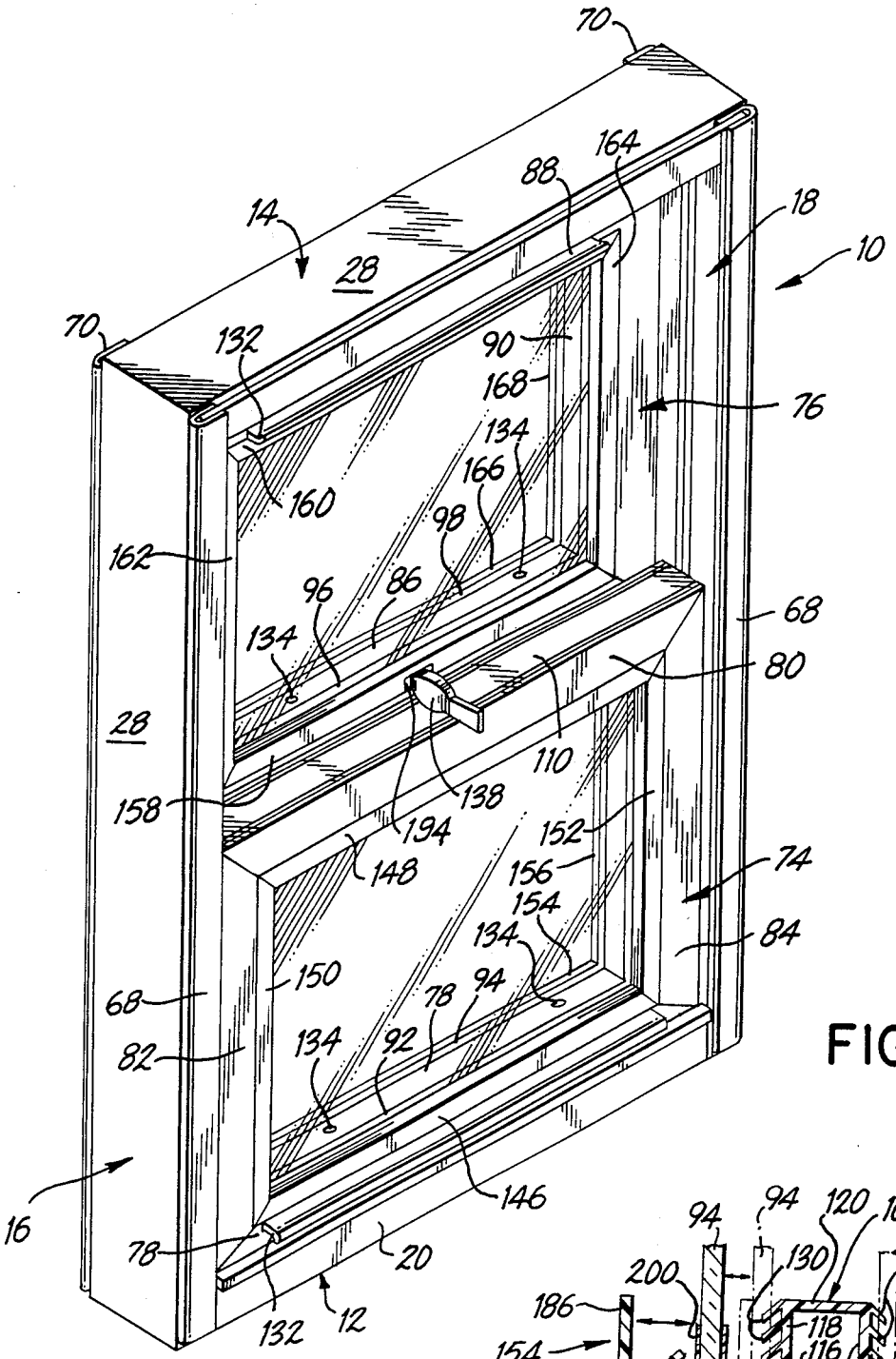
FIG. 1 is a perspective view of a double hung replacement window embodying the invention, as seen from the side thereof destined to face indoors.

The drawing shows a replacement double hung window, indicated generally at 10, embodying the invention in its several aspects.

Window 10 comprises a rectangular frame having a sill member 12, a head member 14, a left side member 16 and a right side member 18. Members 12, 14, 16 and 18 are conveniently fabricated of extrusions of suitable plastic material, a suitable example of which is polyvinyl chloride (PVC). The extrusions for members 14, 16 and 18 are identical, but that for member 12 is different.

The extrusion for sill member 12 is essentially 0.093 inch (0.24 cm) thick and has a vertical inner flange portion 20 and a main portion 22 integral with flange portion 20 and providing sill member 12 with a 3° slope, for positive drainage, thus eliminating any need for weep holes. The edge of main portion 22 remote from flange portion 20 has an upwardly facing longitudinal channel 24 about 0.38 inch (0.97 cm) wide and parallel to flange portion 20 and a parallel-sided longitudinal slot 26 beneath channel 24 and having an open end facing away from flange portion 20. The nominal width of slot 26 is about 0.125 inch (0.32 cm) and the thickness of the material forming the sides of slot 26 is about 0.06 inch (0.15 cm) to allow some flexibility. The bottom of channel 24 is provided by a flange portion 25 and slot 26 is provided by flange portion 25 and an additional flange portion 27 therebeneath. The depth of slot 26 is about 0.44 inch (1.12 cm).

Figure 2:
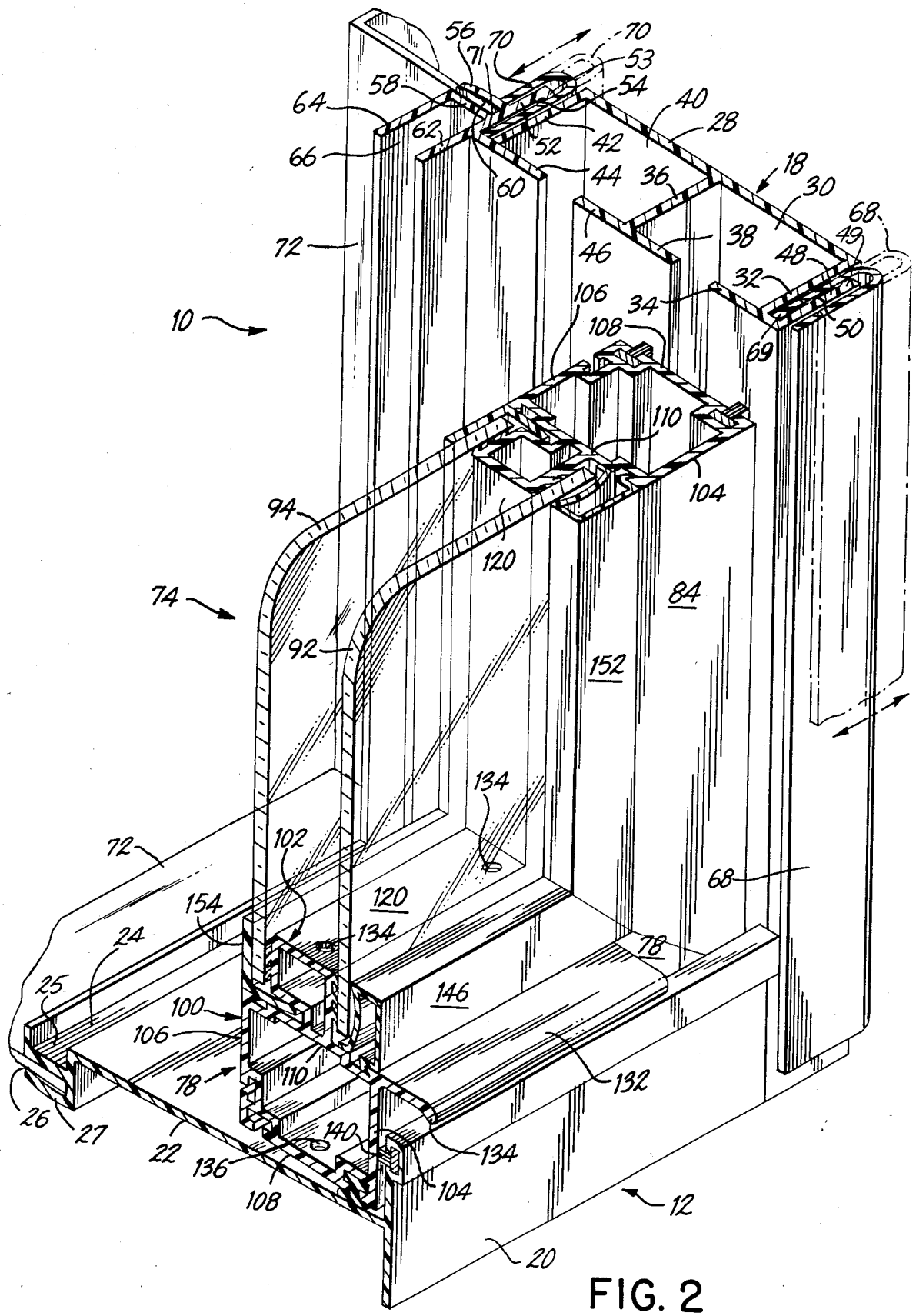
FIG. 2. is a fragmentary enlarged perspective view, partly in section of the lower righthand corner of the window of FIG. 1, but showing the frame and the inner sash thereof, the outer sash being omitted.

The extrusion for head member 14, left side member 16 and right side member 18 will be described with particular reference to right side member 18 as seen in FIG. 2. This extrusion, like that for sill member 12, is essentially 0.093 inch (0.24 cm) thick, and has a planar peripheral wall portion 28, and a first longitudinal channel 30. Channel 30 is provided by wall portion 28, a planar inner flange or wall portion 32 perpendicular to wall portion 28, a planar flange portion 34 perpendicular to flange portion 32 and overlying wall portion 28, a central flange portion 36 perpendicular to wall portion 28, and a planar flange portion 38 perpendicular to flange portion 36 and coplanar with and extending toward flange portion 34 and overlying wall portion 28, there being a longitudinal, parallel-sided gap between flange portions 34 and 38. The extrusion also has a second longitudinal channel 40. Channel 40 is provided by wall portion 28, a planar outer flange portion 42 perpendicular to wall portion 28, a planar flange portion 44 perpendicular to flange portion 42 and overlying wall portion 28, central flange portion 36 and a planar wall portion 46 perpendicular to flange portion 36 and coplanar with and extending toward flange portion 44 and overlying wall portion 28, there being a longitudinal, parallel-sided gap between flange portions 44 and 46. It is noted that flange portion 46 is an integral continuation of flange portion 38, and that flange portions 34, 38, 44 and 46 are equidistant from wall portion 28 and that channels 30 and 40 are of the same dimensions.

The extrusion for head member 14, left side member 16 right side member 18 further has, adjacent flange portion 32, a planar flange portion 48 integral with and extending away from flange portion 34 and terminating at a free edge about 0.187 inch (0.47 cm) short of the plane of the surface of wall portion 28 remote from flange portion 34 and providing, with flange portion 32, a parallel-sided slot 50. The extrusion additionally has, adjacent flange portion 42, a planar flange portion 52 integral with and extending away from flange portion 44 and terminating at a free edge about 0.187 inch (0.47 cm) short of the plane of the outer surface of wall portion 28 and providing, with flange portion 42, a parallel-sided slot 54, similar to slot 50. The width of slots 50 and 54 is about 0.136 inch (0.35 cm) and their depth is about 0.688 inch (1.75 cm).

Extending perpendicularly outwardly from flange portion 52 are a flange portion 56 and a flange portion 58, providing a parallel-sided slot 60 therebetween. The distance from the free end of flange portion 52 to flange portion 56 is about 0.5 inch (1.27 cm) and the distance between flange portions 56 and 58, i.e., the nominal width of slot 60, is about 0.125 inch (0.32 cm). The depth of slot 60 is about 0.44 inch (1.12 cm).

Extending perpendicularly from flange portion 58, in the direction away from flange portion 56, are a flange portion 62 aligned with flange portion 52 and a flange portion 64 integral with the edge of flange portion 58 remote from flange portion 52. Flange portions 62 and 64 provide therebetween a parallel-sided channel 66 about 0.38 inch (0.97 cm) wide and about 0.687 inch (1.75 cm) deep.

In known fashion, the extrusion for sill member 12, and the extrusion for head member 14, left side member 16 and right side member 18 are cut to desired lengths, dependent upon the size desired for window 10, and assembled to make the frame for window 10, with wall portions 28 of members 14, 16 and 18 on the outsides.

In accordance with a first important aspect of the invention, window 10 further comprises two generally U-shaped expansion elements 68, each having spaced parallel leg portions joined by an arcuate portion. One element 68 is assembled with left side member 16 and the other element 68 is assembled with right side member 18. Each expansion element 68 straddles flange portion 48 of the side member with which it is assembled, having one leg in slot 50, the other leg overlapping flange portion 48 and the arcuate portion overlying the free edge of flange portion 48. Furthermore, each expansion element 68 extends substantially from one longitudinal end of its side member to the other and is movable between a closed or unexpanded position shown in solid lines in FIGS. 1 and 2 and in an expanded or open position shown in dash lines in FIG. 2. In its closed position, the leg of each element 68 that is within slot 50 engages the bottom thereof and the arcuate portion is relatively close to the free edge of flange portion 48, not protruding beyond the plane of the outer surface of wall portion 28.

Further in accordance with the first aspect of the invention, window 10 additionally comprises two generally J-shaped expansion elements 70, each having parallel leg portions of unequal length. One element 70 is assembled with left side member 16 and the other element 70 is assembled with right side member 18. Each expansion element 70 straddles flange portion 52 of the side member with which it is assembled, having the longer leg in slot 54, the shorter leg overlapping flange portion 52 and the arcuate portion overlying the free edge of flange portion 52. Furthermore, each expansion element 70 extends substantially from one longitudinal end of its side member to the other and is movable between a closed or unexpanded position shown in solid lines in FIGS. 1 and 2 and an expanded or open position shown in dash lines in FIG. 2. In its closed position, the longer leg of element 70 engages the bottom of slot 54, the shorter leg of element 70 engages flange portion 56 and the arcuate portion is relatively close to the free edge of flange portion 52, not protruding beyond the plane of the outer surface of wall portion 28.

Elements 68 and 70 can conveniently be formed from extrusions of plastic material, a suitable example of which is PVC. In their expanded or open positions, the arcuate portions of elements 68 and 70 extend up to about 0.5 inch (1.27 cm) beyond the plane of the outer surface of wall portion 28 of that side member 16 or 18 with which elements 68 and 70 are assembled.

Thus, by virtue of expansion elements 68 and 70, the width of window 10 can be expanded by about 0.5 inch (1.27 cm) on each side, for an overall width expansion of about 1 inch (2.54 cm).

In result, the frame of window 10 can be made slightly but significantly narrower than is possible with prior art replacement windows, whereby window 10 can be placed in the opening therefor and then expanded to full size, thus avoiding the necessity for removing existing stop moldings or inside trim during installation of window 10 and avoiding problems of broken moldings, chipped moldings and cracked paint and reducing installation time.

Means are provided for maintaining expansion elements 68 and 70 in assembled relationship with side members 16 and 18 and in desired position with respect thereto. Suitable examples of such means are shown in FIGS. 4 and 5.

Figure 4:
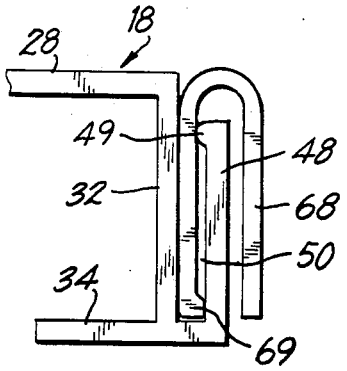
FIG. 4 is an enlarged fragmentary view of a first portion of what is shown in FIG. 2, as viewed from the top thereof.

FIG. 4 is an enlarged fragmentary view looking down on a first portion of what is shown in FIG. 2, namely the portion showing U-shaped expansion element 68. It is seen that flange portion 48 is provided at its free end with a bead 49 constricting the opening of slot 50 and engaging expansion element 68 and urging the same against flange portion 32, while the end of the leg of expansion element 68 that is in slot 50 is provided at its free end with an internal bead 69 overlapping bead 49 and confronting and engaging flange portion 48 and likewise urging expansion element 68 against flange portion 32. Thus, beads 49 and 69 hold expansion element 68 in assembled relationship with right side member 18 and create sufficient frictional drag with flange portion 32 to maintain expansion element 68 in the desired position with respect thereto.

Figure 5:
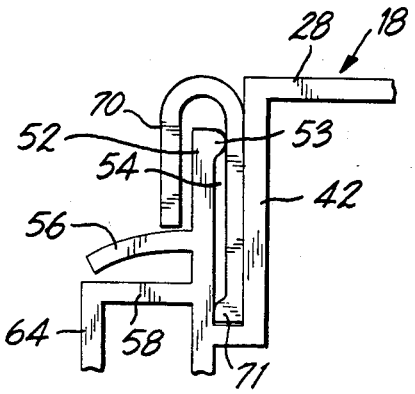
FIG. 5 is an enlarged fragmentary view of a second portion of what is shown in FIG. 2, as seen from the top thereof.

FIG. 5 is an enlarged fragmentary view looking down on a second portion of what is shown in FIG. 2, namely the portion showing J-shaped expansion element 70. It is seen that flange portion 52 is provided at its free end with a bead 53 constricting the opening of slot 54 and engaging expansion element 70 and urging the same against flange portion 42, while the end of the leg of expansion element 70 that is in slot 54 is provided with a bead 71 overlapping bead 53 and confronting and engaging flange portion 52 and likewise urging expansion element 70 against flange portion 42. Thus, beads 53 and 71 hold expansion element 70 in assembled relationship with right side member 18 and create sufficient frictional drag with flange portion 42 to maintain expansion element 70 in the desired position with respect thereto.

In accordance with a second important aspect of the invention, window 10 has a casing slot all the way around its periphery. The casing slot is provided by slot 26 of sill member 12 and slots 60 of head member 14, left side member 16 and right side member 18. While slots 26 and 60 are shown as parallelsided and are described above as having a width of about 0.125 inch (0.32 cm), it is to be understood that they are extruded in an almost closed condition. Thus, an aluminum casing or capping 72 that is 0.019 inch (0.048 cm) thick can be slid into slots 26 and 60, expanding the same and creating therewith a positive seal against air and water infiltration, thus eliminating about half of the caulking labor and material that is required in the installation of prior art replacement windows, in the installation of which the casing is normally returned into the window and caulked.

Casing or capping 72 may be white, bronze or other suitable color and covers the old wood casing (not shown). It is also noted that channel 24 of sill member 12 and channels 66 of head member 14, left side member 16 and right side member 18 form a continuous channel around the frame for holding a screen (not shown).

In a third important aspect of the invention, novel sashes are provided, together with novel means for incorporating panes in the sashes. Window 10 further comprises a generally rectangular inner sash 74, seen in FIGS. 1, 2 and 3, and a generally rectangular outer sash 76, seen only in FIG. 1. It is noted, however, that if FIG. 3 were turned upside down, it would show outer sash 76. The description will proceed on the basis that FIG. 3 shows inner sash 74.

Inner sash 74 comprises a bottom member 78, a top member 80, a left side member 82 and a right side member 84, while outer sash 76 comprises a bottom member 86, a top member 88, an invisible left side member and a right side member 90. Inner sash 74 also includes an inner pane 92 and an outer pane 94, while outer sash 76 also includes an inner pane 96 and an outer pane 98. The bottom, top and side members of sashes 74 and 76 are conveniently fabricated of identical extrusions of plastic material, a suitable example of which is PVC.

Figure 3:
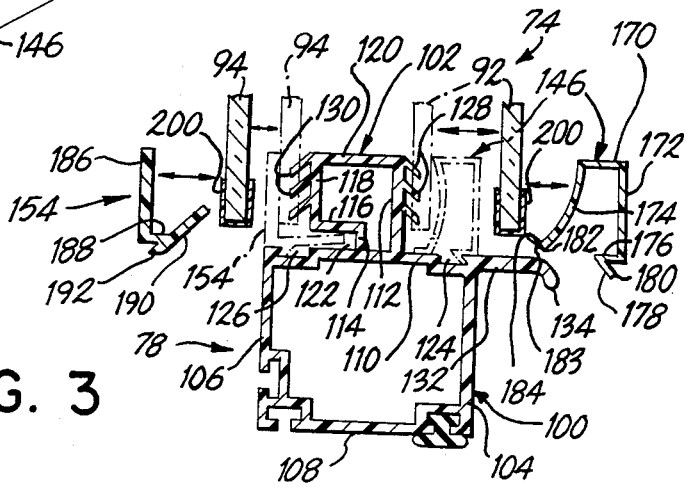
FIG. 3 is a transverse vertical sectional view, partly in phantom and partly exploded, of the bottom member of the inner sash of the window of FIG. 1.

The shape of the extrusion for the bottom, top and side members of sashes 74 and 76 is best seen in FIG. 3, which shows that this extrusion includes a generally rectangular body portion 100 surmounted by a smaller pane holding portion 102. The wall thickness of portions 100 and 102 is about 0.06 inch (0.15 cm). Body portion 100 has side walls 104 and 106, destined to face indoors and outdoors, respectively, an outer wall 108 and an inner or base wall 110. The distance between the outer faces of side walls 104 and 106 is about 1.406 inch (3.57 cm) and the distance between the outer faces of outer wall 108 and wall 110 is about 1.187 inch (3.01 cm). Pane holding portion 102 has a wall 112 perpendicular to and integral with wall 110 and spaced about 0.56 inch (1.42 cm) from the plane of the outer surface of wall 104, a wall 114 perpendicular to and integral with wall 110 and spaced about 0.593 inch (1.51 cm) from the plane of the outer surface of wall 106, a wall 116 integral with the upper edge of wall 114 and parallel to wall 110 and extending from wall 114 in the direction away from wall 112, a wall 118 integral with the edge of wall 116 and parallel to wall 112 and extending from wall 116 in the direction away from wall 110 and spaced about 0.281 inch (0.71 cm) from the plane of the outer surface of wall 106, and a wall 120 parallel to wall 110 and integral with and joining walls 112 and 118 and spaced about 0.525 inch (1.33 cm) from the plane of the outer surface of wall 110. The distance between wall 110 and wall 116 is about 0.09 inch (0.23 cm) and walls 110 and 116 provide a slot 122 bottomed by wall 114 and opening in the direction facing the plane of wall 106. The exposed surface of wall 110 is provided with a dovetail groove 124 between walls 104 and 112 and with a dovetail groove 126 between walls 106 and 114, and the extrusion also provides flexible fins 128 extending diagonally downwardly and outwardly from the exterior of wall 112 and similar flexible fins 130 extending downwardly and outwardly from the exterior of wall 118. As shown, there are three fins 128 and three fins 130, but this number could be more or less.

The extrusion being described further has an external longitudinal flange 132 integral with the juncture of walls 104 and 110 and forming a continuation of wall 110 and extending to a free edge 134 that is curved in the direction to overlap wall 104. Flange 132 is removed from the extrusion except for the portions thereof which become lower member 78 of inner sash 74 and upper member 88 of outer sash 76, for which flanges 132 become sash manipulating handles.

The extrusion for the bottom, top and side members of inner and outer sashes 74 and 76 is cut to desired lengths, dependent upon the size desired for sashes 74 and 76, and, as aforementioned, longitudinal flange 132 is removed from the cut extrusion lengths, except those for lower member 78 of inner sash 74 and upper member 88 of outer sash 76. Also, the cut extrusion length for lower member 78 of inner sash 74 is provided with holes 134 through wall 120, holes (not shown) through wall 110 and holes 136 (only one being shown) through wall 108, to provide means for drawing air into the space between panes 92 and 94. Furthermore, a pivotable locking bar 138 is centrally mounted in known fashion on the exterior of wall 110 of top member 80 of inner sash 74. The bottom, top and side members of inner and outer sashes 74 and 76 are then assembled with each other in known fashion, as shown. Bottom member 86 of outer sash 76 is likewise provided with holes 134 and holes (not shown) like holes 136.

Sashes 74 and 76 are assembled in the frame of window 10 in known manner and include known means (not shown) engaging channels 30 and 40 of left side member 16 and right side member 18. Furthermore, and also in known manner, various sealing elements are provided as needed, one such sealing element being indicated at 140 in FIG. 2 between sill member 20 and bottom member 98 of inner sash 74.

Further in accordance with the third aspect of the invention, inner sash 74 further comprises a lower inner molding 146, an upper inner molding 148, a left side inner molding 150, a right side inner molding 152, a lower outer molding 154, an upper outer molding (not shown), a left side outer molding (not shown), and a right side outer molding 156, and outer sash 76 further comprises a lower inner molding 158, an upper inner molding 160, a left side inner molding 162, a right side inner molding 164, a lower outer molding 166, an upper outer molding (not shown), a left side outer molding (not shown) and a right side outer molding 168.

The inner and outer moldings coact with grooves 124 and 126 and with fins 128 and 130 which already have been described, in attaining the benefits of this third aspect of the invention. All inner moldings are conveniently fabricated from an extrusion of resilient plastic material, a suitable example of which is PVC. The inner moldings have, when unstressed, the cross sectional shape indicated in solid lines for lower inner molding 146 in FIG. 3. All outer moldings are conveniently fabricated from an extrusion of resilient plastic material, a suitable example of which is PVC. The outer moldings have the cross sectional shape indicated in solid lines for lower outer molding 154 in FIG. 3.

As seen in FIG. 3, the extrusion for the inner moldings is of approximately constant wall thickness, typically about 0.03 inch (0.076 cm), having a planar top portion 170, a planar wall portion 172 perpendicular to and depending from a first longitudinal edge of top portion 170, an outwardly concave wall portion 174 depending from a second longitudinal edge of top portion 170 and centered at a center of curvature coplanar with top portion 170 and spaced about 0.75 inch (1.9 cm) from the second longitudinal edge of top portion 170 and about 1.063 inches (2.7 cm) from the first longitudinal edge of top portion 170. The radius of curvature of concave wall portion 174 is about 0.75 inch (1.9 cm). The height of wall portion 172 is about 0.625 inch (1.59 cm). Perpendicular to the lower longitudinal edge of wall portion 172 and extending in the direction to underlie top portion 170 is a bottom portion 176, extending from the longitudinal edge of bottom portion 176 diagonally downward at a 45° angle is a barb portion 178 having a free longitudinal edge 180 located about 0.06 inch (0.15 cm) below bottom portion 178 and about 0.06 inch (0.15 cm) from the plane of wall portion 172 and on the same side of that plane as top portion 170. Concave wall portion 174 extends to a lower longitudinal edge 182 that is located about 0.5 inch (1.27 cm) below top portion 170, and a foot portion 183 extends diagonally upwardly at a 30° angle from longitudinal edge 182 about 0.093 inch (0.24 cm) to a free longitudinal edge 184. Wall portion 174 is resiliently flexible toward wall portion 172 from the position shown in solid lines in FIG. 3 to the position shown in broken lines in FIG. 3.

As also seen in FIG. 3, the extrusion for the outer moldings has a planar wall portion 186 that is about 0.093 inch (0.24 cm) thick and about 0.625 inch (1.59 cm) high, a planar bottom portion 188 perpendicular to wall portion 186 and extending from the lower longitudinal edge thereof and a planar ramp portion 190 integral with bottom portion 188 at the edge thereof remote from wall portion 186 and extending both above and below bottom portion 188. Ramp portion 190 normally makes an angle of about 40° with bottom portion 188. The width of ramp portion 190 is about 0.44 inch (1.2 cm) and its thickness is about 0.05 inch (0.13 cm). The lower longitudinal edge of ramp portion 190 is horizontal and is about 0.06 inch (0.15 cm) below bottom portion 188 and furnishes a barb 192, the point of which lies in a plane that is parallel to and between the two planes of wall portion 86 and spaced about 0.06 inch (0.15 cm) from the plane of wall portion 86 remote from bottom portion 188. Ramp portion 90 is resiliently flexible about its juncture with bottom portion 188 to decrease the angle it makes therewith.

The completion of the assembly of sashes 74 and 76 by the incorporation of panes 92, 94, 96 and 98 therein will now be described, with particular reference to FIG. 3, which shows bottom member 78 of sash 74, pane 92, pane 94, lower inner molding 146 and lower outer molding 154. The assembly of the other moldings and their respective sash members and moldings is the same.

Pane 92 is placed against flexible fins 128 of bottom member 78, top member 80, left side member 82 and right side member 82, and molding 146, cut to proper length, is pressed against pane 92, wall portion 174 first, with foot portion 183 entering a gap between pane 92 and flange 132. Force is exerted against wall portion 172 in the direction toward flexible fins 128, flexing wall portion 174 toward wall portion 172 and eventually causing barb portion 178 to snap into dovetail groove 124 with free longitudinal edge 180 retaining barb portion 178 in groove 124. During this operation, free longitudinal edge 184 clears the adjacent edge of pane 92 and at the conclusion of the operation, foot portion 183 substantially conforms to wall 110. Also, during this operation, pane 92 is forced against flexible fins 128, resiliently deforming same and creating a seal therewith.

Two further points should be mentioned here. First, molding 158, i.e., the lower inner molding for outer sash 76, is provided with a central notch 194 for engagement by locking bar 138. Second, installation of all inner moldings is the same whether or not flange 132 is present.

Pane 94 is placed against flexible fins 130 of bottom member 78, top member 80, left side member 82 and right side member 82, and wall portion 186 of molding 154, cut to proper length, is pressed against pane 94, with that part of ramp portion 190 above bottom portion entering a gap between pane 94 and the juncture of walls 106 and 110. Force is exerted against wall portion 186 in the direction toward flexible fins 130. That part of ramp portion 190 immediately below bottom portion 188 engages the juncture of walls 106 and 110, causing ramp portion 190 to pivot about its juncture with bottom portion 188 in the direction to decrease the angle between bottom portion 188 and ramp portion 190, allowing ramp portion to enter slot 122 and barb 192 to snap into dovetail groove 126. During this installation, pane 94 resiliently deforms flexible fins 130 and creates a seal thereiwth, thus completing the installation of molding 154 and pane 94, with wall portion 186 flush with side wall 106.

It is noteworthy that the moldings create an attractive, built-in look while at the same time, should the glass break, it can be easily changed by snapping out the pertinent inside moldings, using a butter knife or a putty knife to pry wall portion 172 inward, causing barb portion 178 to become disengaged from groove 124.

As a safety feature, panes 92 and 94 are shown in FIG. 3 as having safety guards 200 covering and adhered to their outer periphery to facilitate safe handling by the user. Panes 96 and 98 are likewise provided with these guards, that may be of plastic material, such as PVC film.

Also, the snap-in moldings of the invention and their associated flexible fins enables an increase to 1 inch (2.54 cm) in the distance between the remote surfaces of the inner and outer panes. The advantage of this dimensional increase is described above and has been achieved by the use of two different moldings, the inner moldings being relatively thick in the direction perpendicular to the glass to permit removal and the outer moldings being thin in the direction perpendicular to the glass, to save space. Furthermore the moldings permit the use of insulating glass rather than insulated glass.

It is evident that the invention attains the stated objects and advantages and others.

The disclosed details are exemplary only and are not to be taken as limitations on the invention, except as those details may be included in the appended claims.

What is claimed is:

1. A window construction comprising a frame having a first side destined to face indoors and a second side opposite said first side, said frame including first and second parallel side members having peripheral wall portions with oppositely facing parallel outer surfaces spaced a predetermined distance apart and defining a nominal frame width, said first member having inner and outer parallel oppositely facing surfaces perpendicular to and intersecting said outer surface of said first member, an inner longitudinally extending flange portion having a free edge and a flange portion surface confronting said inner surface and defining therewith a longitudinal inner slot adjacent said first side, an outer longitudinally extending flange portion having a free edge and a flange portion surface confronting said outer surface and defining therewith a longitudinal outer slot adjacent said second side, an inner expansion member associated with said inner slot and having a pair of leg portions joined by an arcuate portion, said leg portions being on opposite sides of said inner flange portion with one of said leg portions being in said inner slot and said arcuate portion passing over said free edge, and an outer expansion member associated with said outer slot and having a pair of leg portions joined by an arcuate portion, said leg portions of said outer expansion member being on opposite sides of said outer flange portion with one of said leg portions of said outer expansion member being in said outer slot and said arcuate portion of said outer expansion member passing over said free edge of said outer flange portion, each said expansion member being movable between a closed position in which its said arcuate portion is relatively close to said free edge of its associated flange portion and an open position in which its said arcuate portion extends beyond said plane of said outer surface of said first member, effectively to increase the width of said frame above said nominal width.

2. A window construction according to claim 1 wherein said slots and said expansion members extend substantially the full length of said first member.

3. A window construction according to claim 2 wherein said free edge of each said flange member is located short of said plane of said outer surface of the wall portion of said first member and, when said expansion members are in their said closed positions said arcuate portions thereof do not extend beyond said plane of said outer surface of the wall portion of said first member.

4. A window construction according to claim 3 wherein said first member is fabricated of an extrusion of plastic material.

5. A window construction according to claim 4 wherein said plastic material is PVC.

6. A window construction according to claim 2 wherein said inner expansion member is fabricated from an extrusion of plastic material and said outer expansion member is fabricated from an extrusion of plastic material.

7. A window construction according to claim 6 wherein said plastic material is PVC.

8. A window construction according to claim 6 wherein said second member is fabricated from said extrusion of plastic material, whereby said second member includes inner and outer slots the same as said inner and outer slots of said first member, said window construction further including inner and outer expansion members associated with said inner and outer slots, respectively, of said second member in the same manner in which said inner and outer expansion members of said first member are associated therewith.

9. A window construction according to claim 1 wherein said first member further includes an additional flange portion projecting away from said first side from said outer flange portion at a location intermediate said free edge of said outer flange portion and the bottom of said outer slot, and said inner expansion member is U-shaped and said outer expansion member is Jshaped, having a longer leg and a shorter leg, said longer leg being in said outer slot and said shorter leg confronting said additional flange portion.

10. A window construction according to claim 1 further comprising means for maintaining said expansion elements in assembled relationship with said first side member and in desired position with respect thereto.

11. A window construction according to claim 10 wherein said means includes a bead on each said expansion element and located in its said associated slot.

12. A window construction according to claim 10 wherein said means includes beads on said first side member constricting said longitudinal inner and outer slots.

13. A window construction according to claim 10 wherein said means includes cooperating beads on said expansion elements located in their said associated slots and beads on said first side member constricting said longitudinal inner and outer slots, said beads on said expansion elements overlapping said beads on their said associated slots.

* * * * *